United States Patent [19]

Huang

[11] Patent Number: 5,050,414

[45] Date of Patent: Sep. 24, 1991

[54] STRUCTURE OF KEY-RING ASSEMBLY

[76] Inventor: Yu-Hwei Huang, No. 5, Alley 2, Lane 85, Min Tsu Road, Lu Chou Hsiang,, Taipei Hsuan, Taiwan

[21] Appl. No.: 561,429

[22] Filed: Aug. 1, 1990

[51] Int. Cl.[5] ..... A44B 15/00

[52] U.S. Cl. ..... 70/456 R; 70/459

[58] Field of Search ..... 70/456 R, 459; 24/3 R, 24/3 K, 643-645, 652

[56] References Cited

U.S. PATENT DOCUMENTS

| | | | |
|---|---|---|---|
| 1,530,688 | 3/1925 | Murray | 70/458 X |
| 2,896,290 | 7/1959 | Salm et al. | 70/456 R X |
| 4,317,638 | 3/1982 | Klaber | 70/459 X |
| 4,319,384 | 3/1982 | Horne | 24/3 R |
| 4,391,113 | 7/1983 | Jorgens | 70/459 |
| 4,524,592 | 6/1985 | Saitoh | 70/287 |
| 4,524,594 | 6/1985 | Bascou | 70/459 X |
| 4,584,858 | 4/1986 | Wolter | 70/459 X |
| 4,765,460 | 8/1988 | Vigueras Pacheco | 70/456 R X |
| 4,776,191 | 10/1988 | MacDonald | 70/459 |

*Primary Examiner*—Gary L. Smith
*Assistant Examiner*—Suzanne L. Dino
*Attorney, Agent, or Firm*—Lowe, Price, LeBlanc & Becker

[57] ABSTRACT

A key-ring assembly comprising a casing having fastened therein a lock bolt mechanism, a locating device and a blade cutter. The blade cutter can be rotated out of or inside the casing within an angle of 180 and is controlled by the locating device to position at three predetermined positions. The lock bolt mechanism comprises two opposite bolts respectively controlled to move forward and backward by two push knobs so as to respectively close or open a slide way for the fastening therein of key-rings, and an opening for mounting the casing on the waist belt.

1 Claim, 4 Drawing Sheets

STRUCTURE OF KEY-RING ASSEMBLY

BACKGROUND OF THE INVENTION

The present invention relates to key-rings, and, more particularly, to a key-ring assembly for holding keys with a blade cutter attached thereto for cutting.

A regular key-ring is generally comprised of a metal ring attached to an ornament for holding a bunch of keys.

It is an object of the present invention to design a key-ring assembly with a blade cutter attached thereto for cutting, which can be conveniently adjusted according to the number of being of keys to held.

SUMMARY OF THE INVENTION

According to the present invention, a key-ring assembly comprises a casing having fastened therein a lock bolt mechanism at one side and a locating device at an adjacent side. The lock bolt mechanism includes two opposite bolts respectively controlled to move forward and backward by two push knobs and having received therein two opposite socket inserts with a spring element retained therebetween. The locating device is comprised of an insert, a compression spring and a steel ball at an adjacent side. A blade cutter is fastened in an elongate recess inside the casing opposite to the lock bolt mechanism and is rotatable out of or inside the casing through an angle of 180°. The blade cutter has a plurality of notches around its mounting end selectively releasably engageble with a steel ball of the locating device to firmly retain the blade cutter at a selected position. A retaining channel is formed inside the casing opposite to the locating device. A feed hole in the casing is disposed in communication with the retaining channel. The feed hole is constantly blocked by one bolt of the lock bolt mechanism. An opening in the casing is constantly closed by the other bolt of the lock bolt mechanism. By pushing the two push knobs forward and backward, the feed hole can be opened and closed for fastening one or more key-rings in the retaining channel, and the opening can be opened and closed for mounting the casing on the waist belt.

DETAILED DESCRIPTION OF THE PREFERRED EMBODIMENT

Figure 1:
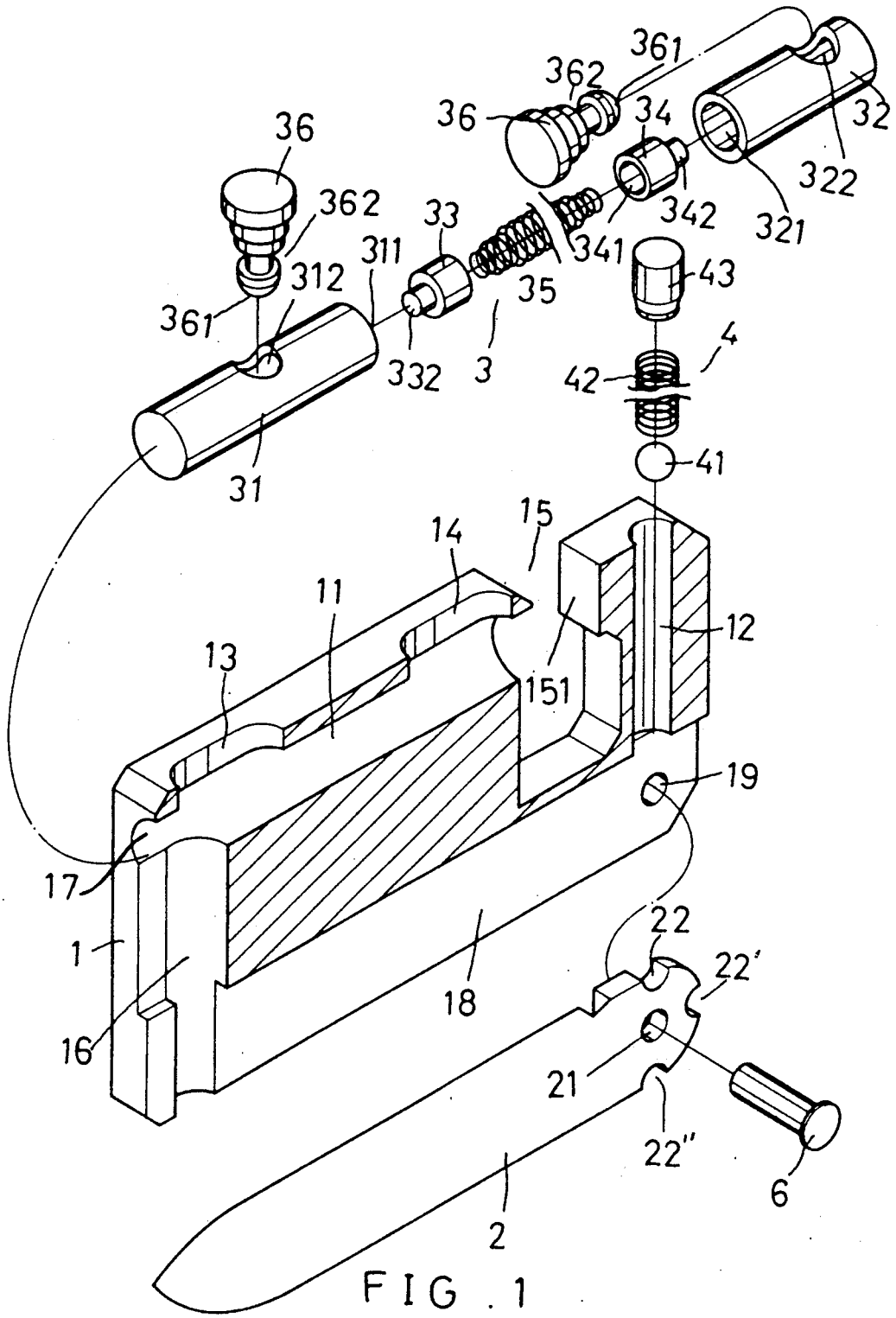
FIG. 1 is an exploded view of the preferred embodiment of the present invention.
Figure 2:
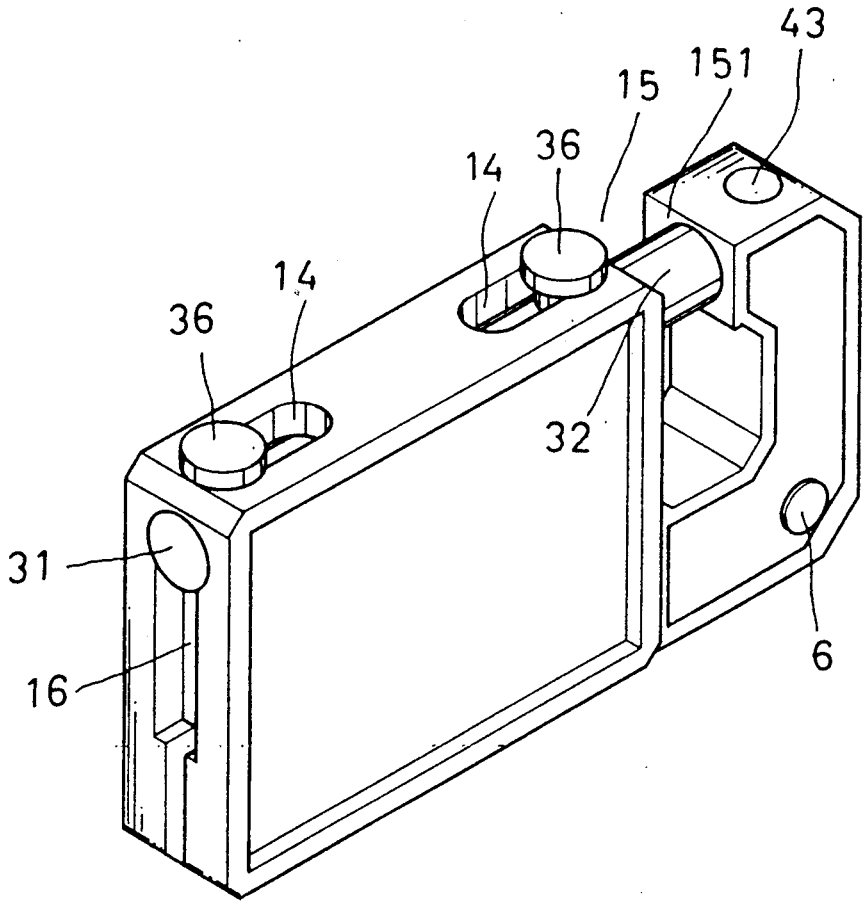
FIGS. 2 and 3 are perspective views of the key-ring assembly of the present invention taken from different angles of view.
Figure 3:
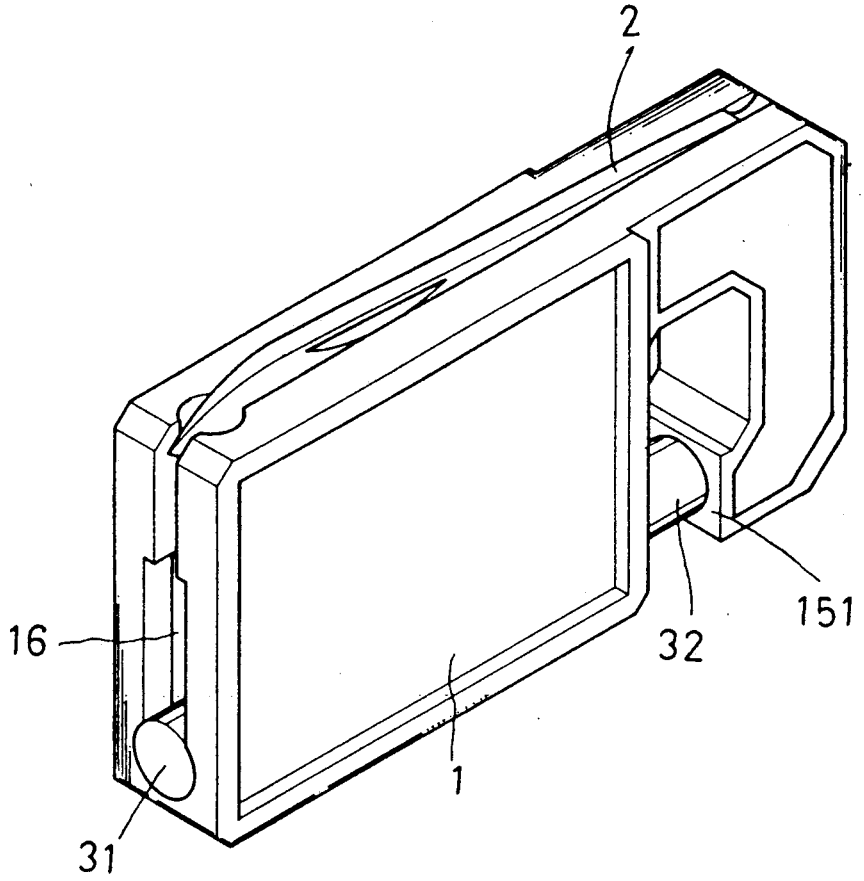
Figure 4:
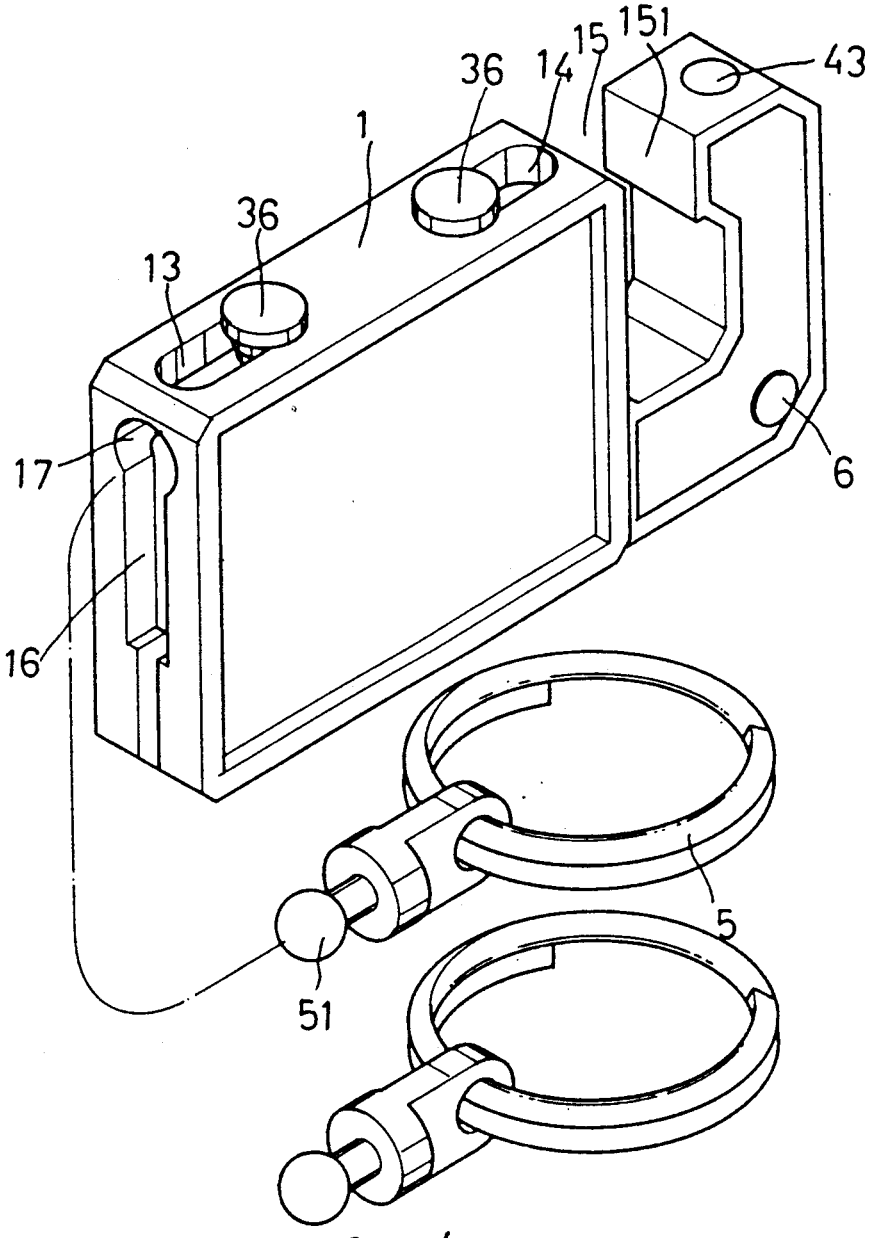
FIG. 4 illustrates the key-ring assembly of the present invention, in which a key-ring is separated from the casing.

A key-ring assembly embodying the present invention generally comprises a casing 1, a blade cutter 2, a lock bolt mechanism 3, a locating device 4 and at least one key-ring 5.

Two elongate holes 11, 12 are formed inside the casing 1 at two adjacent sides respectively for holding a lock bolt mechanism 3 and a locating device 4. Two notches 13, 14 are formed on the casing 1 at one side and respectively in communication with the first elongate hole 11. An opening 15 is formed in the casing 1 between the first and second elongate holes 11, 12. A retaining channel 16 is made inside the casing 1 at one side opposite the second elongate hole 12. A feed hole 17 is made on the casing 1 at a location respectively in communication with the channel 16 and the first elongate hole 11. An elongate recess 18 is made inside the casing 1 opposite to the first elongated hole 11 and with its two opposite ends respectively in communication with the second elongate hole 12 and the channel 16. A pin hole 19 is made on the elongate recess 18 at one end thereof for fastening a lock pin 6 to secure a blade cutter 2 thereto.

Blade cutter 2 according to the present invention comprises a mounting hole 21 at one end thereof through which a lock pin 6 is inserted to secure the blade cutter 2 to the pin hole 19 on the elongate recess 18, permitting the blade cutter 2 to rotate below the elongate recess 18 through an angle of 180°. A plurality of notches 22, 22', 22'' are formed on the blade cutter 2 around the periphery of its mounting end, i.e. around the mounting hole 21, for selective engagement with a steel ball 41 for positioning control.

A lock bolt mechanism 3 of the present invention generally comprises two bolts 31, 32, two socket inserts 33, 34, a compression spring 35 and two push knobs 36. The two opposite ends of the compression spring 35 are respectively set inside the blind holes 331, 341 of the socket inserts 33, 34, and the socket inserts 33, 34 are respectively inserted in the bores 311, 321 of the bolts 31, 32. After the two bolts 31, 32 are squeezed to connect in series with the compression spring 35 and the two socket inserts 33, 34 received therein, they are inserted as an assembly inside the first elongate hole 11 permitting the two bolts 31, 32 to respectively stop at the vertical plane 151 of the opening 15 and the side wall of the channel 16 and the feed hole 17. After being inserted in the first elongate hole 11, the two bolts 31, 32 are pushed by the compression spring 35 to bilaterally move apart with the pivot holes 312, 322 thereon respectively disposed right below the two notches 13, 14 on the casing 1 respectively for the fastening therein of the two push knobs 36 outside the casing 1. A push knob 36 according to the present invention has a smoothly tapered bottom end 361 and a circular groove 362 at the middle. Therefore, after push knob 36 is inserted through either notch 13 or 14 into either pivot hole 312 or 322 of either socket insert 33 or 34, the projecting end 332 or 342 of either socket insert 33 or 34 is permitted to move along the tapered bottom end 361 into the circular groove 362 to firmly secure push knob 36 inside the bolt 31 or 32.

A locating device 4 according to the present invention is comprised of a steel ball 41, a compression spring 42 and an insert 43. After the insert 43, the compression spring 42 and the steel ball 41 are respectively inserted inside the second elongated hole 12, the compression spring 42 is firmly retained by the insert 43 in position to pull the steel ball 41 to partly project over the elongated recess 18 for locking in either of the notches 22, 22', 22'' to retain the blade cutter 2 in a selected position.

A key-ring 5 according to the present invention comprises a spherical head 51 which can be inserted through the feed hole 17 to channel in the slide 16.

After assembly, the blade cutter 2 can be rotated away from the elongated recess 18 to extend from casing 1 at an angle of 90° or 180° relative to the elongated recess 18 by means of engagement of the steel ball 41 in either of the notches 21', 21'' thereof.

A key-ring 5 is fastened to casing 1 as follows. The first push knob 36 is pushed inward to retract the first bolt 31 from the feed hole 17, and then the spherical head 51 is inserted through the feed hole 17 inside the channel 16. After the pushing force is released from the first push knob 36, the compression spring 35 of the lock bolt mechanism 3 immediately pushes the first bolt 31 outward to block the feed hole 17. Thus, the key-ring 5 becomes firmly retained inside the channel 16. According to the present invention, a plurality of key-rings 5 may be simultaneously fastened inside the channel 16 for holding keys respectively.

In normal condition, the second bolt 32 is pushed by the compression spring 35 of the lock bolt mechanism 3 to close the opening 15. By means of the control of the second push knob 36, the second bolt 32 can be pushed inward to open the opening 15 for mounting the casing 1 on a waist belt. After the pushing force is released from the second push knob 36, the compression spring 35 of the lock bolt mechanism 3 immediately pushes the second bolt 32 back to its original position to close the opening 15.

I claim:

1. A key-ring assembly, comprising a casing, a blade cutter, a lock bolt mechanism, a locating device and at least one key-ring, said casing having internally therein a first elongate hole at one side thereof, a second elongate hole opening at another side thereof adjacent said first elongate hole, an elongate recess at a further side of the casing opposite to said first elongate hole, said elongate recess having a pin hole at one end, a retaining channel at a side of the casing opposite to said second elongate hole, and a pair of external notches extending along said one side and respectively in communication with said first elongate hole, an opening between said first and second elongate holes and a feed hole respectively in communication with said retaining channel and said first elongate hole; wherein said blade cutter includes a mounting hole at one end thereof corresponding to said pin hole for the insertion therein of a lock pin to secure said blade cutter to said elongate recess and permitting said blade cutter to rotate on said lock pin through an angle of 180°, said blade cutter further comprising a plurality of notches formed on the periphery of said one end around said mounting hole for positioning control; and positioning device means for selectively locking and positioning said blade cutterr at selected angles relative to said elongate recess, said positioning device means including an insert, a compression spring and a ball member respectively received inside said second elongate hole with said compression spring firmly retained by said insert to bias said ball to partly project over said elongate recess for locking in either of the notches of said blade cutter to retain said blade cutter in a slected position.

* * * * *